US006866591B2

(12) United States Patent
Bennett

(10) Patent No.: US 6,866,591 B2
(45) Date of Patent: Mar. 15, 2005

(54) DUAL PURPOSE GOLF PUTTING PRACTICE DEVICE

(76) Inventor: John Emmanuel Bennett, 1570 Homewood Dr., Altadena, CT (US) 91001

( * ) Notice: Subject to any disclaimer, the term of this patent is extended or adjusted under 35 U.S.C. 154(b) by 0 days.

(21) Appl. No.: 10/101,995

(22) Filed: Mar. 20, 2002

(65) Prior Publication Data

US 2003/0181252 A1 Sep. 25, 2003

(51) Int. Cl.[7] ..... A63D 69/36
(52) U.S. Cl. ..... 473/188
(58) Field of Search ..... 473/186–189, 473/195

(56) References Cited

U.S. PATENT DOCUMENTS 1,742,702 A * 1/1930 Goodloe ..... 473/75
2,467,549 A * 4/1949 Ely et al. ..... 473/188
2,788,977 A * 4/1957 Lusk ..... 473/187
3,791,653 A * 2/1974 Yamada ..... 473/186
3,854,728 A * 12/1974 Brandell ..... 473/183
3,873,097 A * 3/1975 Willis ..... 473/189
4,896,886 A * 1/1990 Colley ..... 473/157
5,181,721 A * 1/1993 Halliburton ..... 473/189

FOREIGN PATENT DOCUMENTS

GB 14649 * 8/1916 ..... 273/177 A
GB 2257637 * 1/1993 ..... 273/177 A

* cited by examiner

*Primary Examiner*—Mark S. Graham
(74) *Attorney, Agent, or Firm*—John E. Bennett

(57) ABSTRACT

This invention, the "Dual Purpose Golf Putting practice Device", is characterized by two unique concepts which offers the player a practice device which better simulates the conditions of putting on the golf course green. One is a "vertical target hole", constructed with "Flaps", into which properly putt balls role, and disappears as into the hole on the golf course green. The other is the arrangement of "Flaps"in rows, which intercept balls according to their rolling force, enabling the player to practice the required force for putting from various distances. The device consists of a housing, having no bottom surface, a target cage, which provides a circular target as the hole, and row or rows of "Flaps", which indicate the force of the rolling ball.

10 Claims, 2 Drawing Sheets

DUAL PURPOSE GOLF PUTTING PRACTICE DEVICE

BACKGROUND OF THE INVENTION

Most putting devices require a method for the ball to rise so that it may than be able to fall into a hole, using such obstacles as a hinge mechanism, a ramp, or some other obstacle, which creates an unatural interference for the ball, inorder for it to drop into a hole. To make putting realistic, the ball must roll without interence into the hole. Further, if the hole is missed, practice balls wander around in all directions which then must be collected to resume practicing.

This invention enables the ball to roll freely on a surface and roll into a "vertical hole" on the same surface without accessories.

Further, common devices are for practicing the line to the target hole. This invention provides another advantage in that, the player can also practice the accurate force required for a successful putt.

SUMMARY OF THE INVENTION

This invention provides a putting practice device which remedies the problems mentioned in the "Background of the Invention" and provides other advantageous and is called "Dual Purpose Golf Putting Practice Device". All common practice devices are restricted to practicing the accuracey of the line to the target hole. However, there is the other factor, just as important to practice, and that is being able to control the distance "force" to have the ball stop close to the hole if the hole is missed. This invention provides the second factor in a unique distinct design.

This invention is characterized by two unique concepts, which offer the player a practice device that better simulates the conditions of practicing on the golf course green. One is a "vertical target hole" constructed with "flaps" into which a properly putt ball rolls and disappears, simulating a hole as on the golf course, the other, is the arrangement of Flaps in rows, which intercept the balls according to their rolling force, enabling the player to measure and practice the force required to apply to a ball from various distances to the target. Further, the ball rolls on an even surface without being confronted by contrivances inorder to rise, so that it may fall into a hole.

BRIEF DESCRIPTION OF THE DRAWINGS

Dual Purpose Golf Putting Practiece Device

FIG. 10. Side view, as mounted, of the "first assembly", target cage, showing front flaps, 3, and rear flaps, 3*a,* 3*a* being longer than 3 for control purposes, and suspended from cap 7, surrounded by semi-circular barrier bars, 10 at front and 11 at rear, supported by suspension straps 12, and rear bar, 11, lower than front bar 10, (offset to obtain different rigidity in the two sets of flaps). A-A indicates a cross-section of view to the rear half as shown in FIG. 6.

A BRIEF DESCRIPTION OF THE INVENTION

A Dual Purpose Golf Putting Practice Device

This advanced and unique Dual Purpose Golf Putting Practice Device, makes possible the implementation of an additional basic principle required to make successful putts. Common putting practice devices provide only the means for judging the "line" to the target hole. However, the device presented herewith, provides another basic factor necessary for more accurate and successful putting. This factor is to judge the amount of "force" required for an accurate putt to reach the target from various distances and, so that, if the ball does not enter the hole, it will stop rolling close as possible near the hole. Thus, the term "dual" refers to this device, in enabling the player to practice and improve his putting, both as to the accuracy of the line to the target and the accuracey in judging the force required for successful putting.

Figure 1:
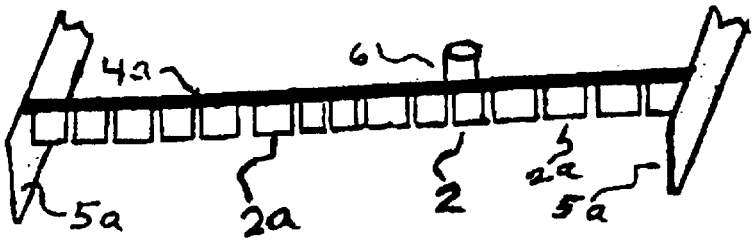
FIG. 1. Top, angle, perspective view of cut front portion of housing, showing the front entrance row of flaps, as the "second assembly", which includes the flaps 2*a,* 2, suspended from beam 4*a* and mounting stud 6. Item 2 represents the few flaps that are intercepted by the first assembly, when it is mounted on stud 6. 5*a* is the extended side of housing.
Figure 2:
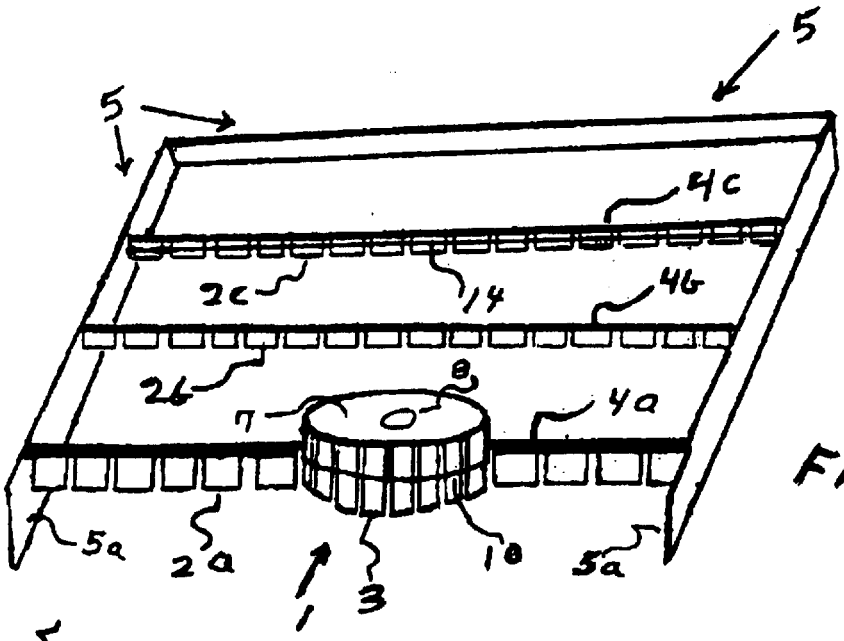
FIG. 2. Top, angle, perspective, front view of the device. Arrow/1, is the "first assembly", mounted on stud 6, see FIG. 1, on "second assembly"/beam 4*a* with flaps 2*a*. Beam 4*b*/flaps 2*b,* is the second row of flaps and beam 4*c*/flaps 2*c* is the third row of flaps. 14 is a barrier bar, in front of flaps 2*c,* extending and attached to the sides of the housing, 5, at the ends. 5*a* is the forward extension of the sides of the housing. 7 is the cap of the housing with suspended flaps 3 and front barrier bar 10. 8 is the mounting knob of cap 7.
Figure 5:
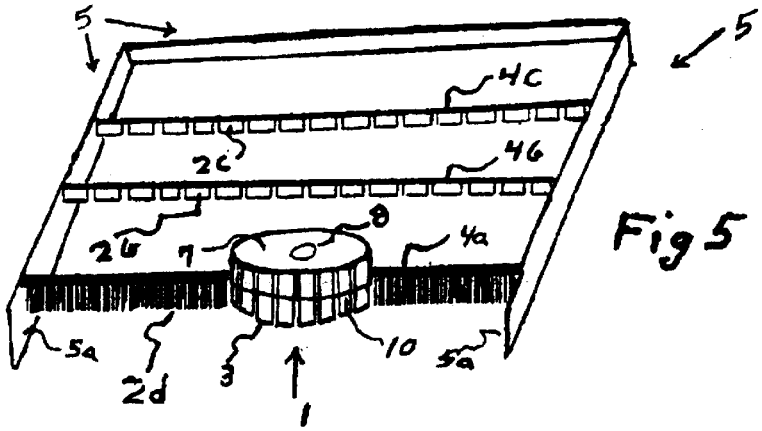
FIG. 5. Complete device as shown in FIG. 2, except flaps 2*a* have been replaced by bristles, 2*d.*

In the construction of this device, the basic components are: the Housing, FIGS. 2 & 5, Item 5, which is a strip forming an enclosure embodying a front row of linear entrance "flaps", Item 2*a,* FIGS. 2,3,4 & 8, suspended from a beam 4*a,* FIGS. 1, 2, 4 & 8, all of which comprise "assembly two". Further, there are additional rows of flaps 4*b* & 4*c,* FIGS. 2 & 5, positioned parallel in linear, horizontal rows at predetermined distances rearward of the front row of entrance flaps. In presentation, only three rows of flaps are shown in the housing.

The "first assembly", indicated by an arrow as is a cylindrical formation of flaps suspended from the "cap". A disc, embodying a "knob" with a shaft extending below the cap and which shaft embodies a bore or a sleeve, 13, FIG. 6, at its end is for mounting on the front row of flaps, "second assembly", by pressing the sleeve on stud stud 6 positioned on top of beam 4*a,* of the first row of flaps. Thus the cylindrical flaps, designated a "Target Cage", straddle beam 4*a,* whereby the front half of the target cage is in front of the row of flaps, intercepting a portion of the linear flaps at its diametrical Center 2 and the rear half of the cylindrical flaps extend rearward from the straddled linear flaps. Thus, the three sets of flaps, the front half of the cylindrical flaps, the intercepted linear flaps through the center of this cylinder, and the rear half of this cylinder, together, form the target of the device, the "first assembly" for measuring the force of the putt by penetration of these three subject set of flaps. Therefore, the positioning of the cylindrical flaps on the front row of flaps, creates a target and the means for measuring the excessive force of the putted ball. Hence the device is a dual purpose entity. Further, the cylindrical cage, may be detached and used on a putting surface apart from the row of flaps, by mounting on a stake, FIG. 9, as mounted on the stud on beam 4*a*. Further, the housing, with its three rows of flaps, may be used as a visual goal to practice and attain the proper force for successful putting from various distance by observing the number of rows penetrated by excessive force. If the ball stops touching the front row, it's a perfect force, if it penetrates the front row and not the second row of flaps, it is a good putt, and if the ball rolls beyond the second row, the force is excessive and needs to be reduced, and if the ball passes the third row of flaps, the force is wild.

The housing, with all its components may be injection molded as an integral unit. Likewise the target cage of cylindrical flaps may also be injection molded as an integral unit. If one desires, the individual components of these units can be molded separately and assembled into a unit, but this would be too costly. The material for these units, may be plastic such as, polypropylene, polyethylene, or ABS, acrylonitrite butadiene styrene. Other types of materials may also be use in constructing the units, such as aluminum, steel, brass.

Opposed sides of housing extend a distance forward of the front row of flaps to catch and collect improperly putted golf balls. Otherwise, missed balls could wander in all directions which would require time and effort to collect.

This device comprises "Flaps" suspended linearly from a beam, 2, 2*a,* 2*b,* 2*c,* FIGS. 1, 2, 3, 4, 5, & 8, also suspended circularly, 3, 3*a,* FIGS. 2, 3, 4, 5, 6, 10 & 11. The dimensions of the flaps are: thickness, 0.025", +0.225", −0.024", width, 1.000", +9.000", −0.999", and its vertical length is, 0.50", +9.50", −0.25". Further, when suspended, the lower edge of the flap is 0.00" to 1.67" above the rolling surface of the ball. When the housing or the target cage is injection molded as a unit, the material of the flaps is the same as the rest of the unit, such as plastics, polypropylene, polyethylene, or acrylonitrite butadiene styrrene. On the other hand, if individual components are assembled, the material may be metals such as aluminum, steel brass, in constructing the unit.

The flaps are suspended strips, as shown in most of the figures. The flaps engage the rolling ball and are deflected by the amount of surface engaging the ball, which depends on the length of the flap, FIG. 11. The flaps control the rolling ball by intercepting, impeding, checking, directing, slowing, stopping, confining and concealing. In addition to the length of material engaging the rolling ball, other factors are paramount in the functioning of the flaps, such as the rigidity or flexibility of the material, their thickness and size and a "barrier bars" placed next to the flaps.

Part or all of the flaps,in this device, can be replaced with bristles with various textures similar to that of paint brushes. The bristles and a strip can be injection molded as a unit. The strip, suspending the bristles, can then be screwed on to the beam or beams, 4*a,* 4*b,* or 4*c,* FIG. 2. 2*d,* FIG. 5.

In order to further control the ball passing through the flaps, there are two "barrier bars" or strips positioned, Horizontally adjacent to the flaps. There are two types of barrier bars of strips, linear and semi-circular. Further, their function is to assist in regulating the rigidity of the flaps and thus control the ball. The linear bar, which is attached to the sides of the housing, 5, FIG. 2, is applied to a linear row of flaps suspended from a beam, 4*c,* FIG. 2. The two semi-circular bars are used with the cylindrically arranged flaps on the target cage, 1 items 10 & 11, FIGS. 2, 5,6,10,11. These bars are suspended with straps, 12, FIGS. 6, 10 & 1, and one semi-circular bar surrounds the front half cylinder, and the other surrounds the rear half of the cylinder. Further, these bars are offset so that the rear bar is lower than the front bar. The longer the extension below the bar, the less rigidity, and conversely, the shorter the extension, the more rigid the flap, 10, 11, 12 & 15, FIGS. FIGS. 6, 10 & 11.

REFERENCED NUMERALS IN THE DRAWINGS

Figure 3:
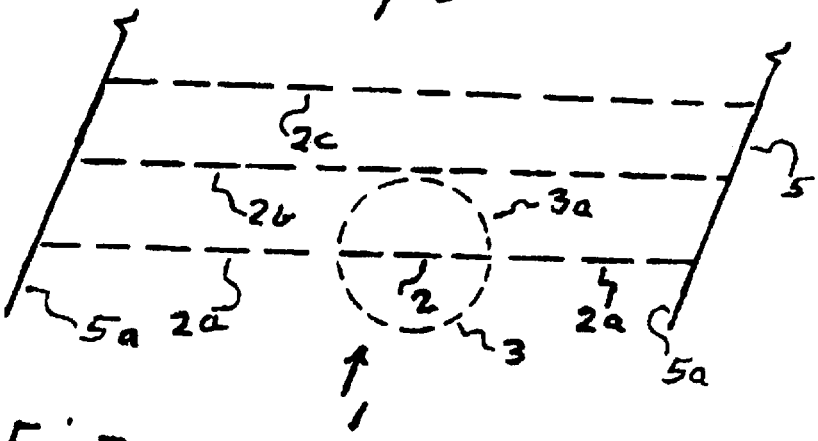
FIG. 3. Top, open view of the device, showing the sides of the housing and the schematic view of all the flaps. Arrow/1, represents the flap arrangement of the first assembly target cage, Flaps 2 are flaps of front row, in the center of the first assembly, and 3 are the front flaps while 3*a* are the rear flaps. View indicates top edges of the flaps with beams and cap removed to show arrangement of flaps.
Figure 4:
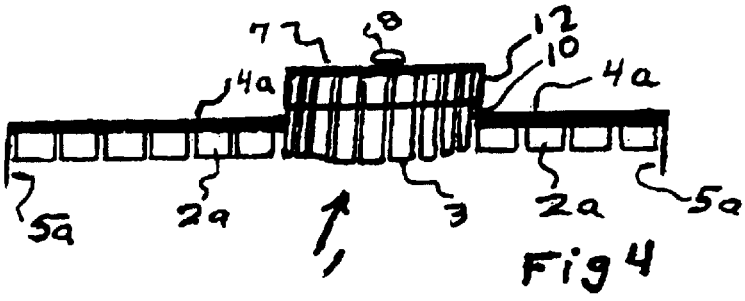
FIG. 4. Front view of the device shown in FIG. 2. Item 10 is the barrier bar surrounding the front half of cylindrical flaps. Item 12 is one of the straps attached to the cap 7 and barrier 10, to support the barrier bar. 2*a*=front row flaps, 3=flaps of the front half of the first assembly, 4*a*=beam supporting flaps 2*a,* 5*a*=extended end of housing, 7 is the cap of assembly, target cage, from which flaps are suspended, and 8 is the knob used in mounting the front assembly to top of beam 4*a* and stud 6 on second assembly.
Figure 6:
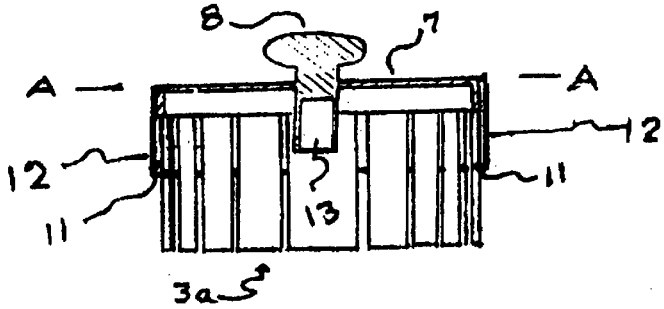
FIG. 6. Is a cross-section view of the "first assembly", A-A, FIG. 10, showing the rear view from the inside, indicating the barrier bar 11, between the flaps 3*a,* suspension straps 12, cap 7, knob 8, and sleeve/end of knob 8, to mount this "first assembly", by pressing sleeve 13, over stud 6, shown in FIGS. 8, 7, 9 & 1.
Figure 7:
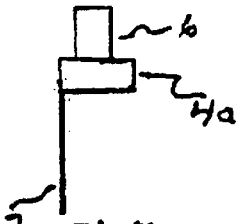
FIG. 7. End view of FIG. 8.
Figure 8:
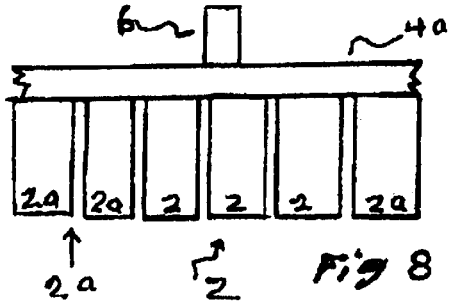
FIG. 8. Front view of portion of front row flaps, 2, 2*a,* suspended from beam 4*a,* comprising stud 6, where the "first assembly", the target cage.
Figure 9:
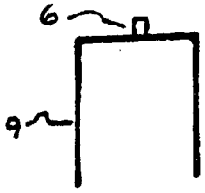
FIG. 9. Front view of stake 9, comprising stud 6, for mounting "first assembly", target cage/FIG. 10.
Figure 10:
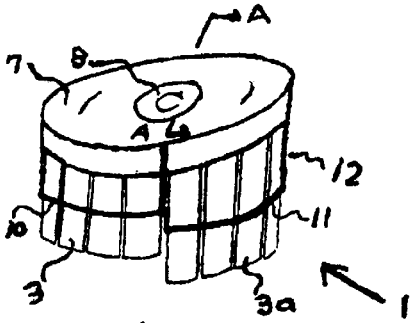
FIG. 10, is mounted straddling flaps 2,2,2 at its center.
Figure 11:
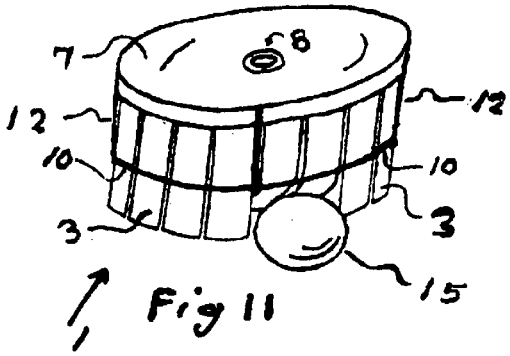
FIG. 11 Shows a golf ball entering the front of the target cage passing under flaps 3.

1. "First Assembly" (1 with arrow) FIGS. 2, 3, 4,5, 10 & 11.
2. Schematic exposed view of flaps intercepted by First Assembly, FIG. 3. Front view of flap 2, FIG. 1, FIG. 8.
3. Front half of Assembly 1, Target Cage, indicating the flaps, FIGS, 2, 3, 4, 10 & 11
3*a*. Flaps of the rear half of the Target Cage, FIGS. 3, 6, 10 & 11.
2*a*. Front row of flaps, together with beam 4*a,* is the "second assembly" FIGS. 1,2, 3, 4,7. FIG. 8/partial showing how flaps are suspended
2*b*. Second row of linear flaps and suspension beam 4*b*. FIGS. 2,3,5.
2*c*. Third row of linear flaps and beam 4*c*. FIGS. 2,3 & 5
2*d* Shows bristles on front row. FIG. 5.
4, *a,b,c,* are suspension beams.
5. Is the housing, FIGS. 2 & 5.
5*a* Forward extension of the sides of the housing. FIGS. 1, 2, 3,4,5.
6. The stud on beam 4*a* and on stake FIGS. 1, 7, 8 & 9
7. Cap or disc, of the first assembly 1. FIGS. 2,4,5,6, 10 & 11.
8. Knob on top of cap. FIGS. 2,4,5,6, 10 & 11.
9. Prongs of stake. FIG. 9.
10. Barrier bar surrounding the front half of assembly 1, target cage., FIGS. 2, 5, 10 & 11.
11. Barrier bar surrounding the rear half of assembly 1, the target cage. FIGS. 6, 10 & 11.
12. Straps holding barrier bars. FIGS. 6, 10 & 11, & 4.
13. Sleeve in knob. FIG. 6.
14. Barrier bar applied to linear row of flaps. FIG. 2.
15. Golf ball entering front of target cage. FIG. 11.

Dual Purpose Golf Putting Practice Device

There are two basic factors and disciplines required to accomplish a successful putt. One is to aim accurately in stroking the ball to the target and the other is to accurately judge the force in stroking the ball so that the ball just reaches the hole, no more, no less, so that if the hole is missed, the ball stops near the hole, and thus securing the second putt. This invention, as defined in the claims, provides a device so that the player can practice either of the basics separately. All such common practice devices provide only a target for practice. This devices provides the mechanism for target practice and the mechanism for force practice, to assis the player in improving his golf putting skill.

What is claimed is:

1. A dual purpose golf putting practice device for use indoors or outdoors comprising:

a first assembly including a plurality of adjacent entry flaps having upper and lower ends, a second assembly including a plurality of adjacent exit flaps having upper and lower ends, the exit flaps of said second assembly being horizontally spaced a predetermined distance rearward of the entry flaps of said first assembly, means for supporting said entry and exit flaps pivotally and vertically above a putting surface on which said device may be positioned so that said entry and exit flaps are horizontally pivotable in response to a putted golf ball rolling across said putting surface and engaging the lower ends of said flaps to indicate both the accuracy of the putted golf ball, and a measure of the putting force of the accurately putted golf ball, and means for detachably connecting said first assembly to said second assembly so that said exit and rearward flaps are spaced apart as aforesaid, and said first assembly may be removed from said second assembly and used on a putting surface apart from said second assembly with the entry flaps thereof responsive to the movement of a putted golf ball as aforesaid.

2. A dual purpose golf putting practice device as recited in claim 1, wherein the first assembly includes a plurality of additional adjacent flaps, said additional flaps being located rearward of said exit flaps of said second assembly when said first assembly and said second assembly are connected together, and said additional flaps being responsive to the movement of a putted golf as aforesaid.

3. A dual purpose golf putting practice device as recited in claim 1, wherein the second assembly is a housing having an entrance, and the entrance to said housing is defined by a front row of flaps corresponding to said exit flaps.

4. A dual purpose golf putting practice device as recited in claim 3, wherein opposed sides of said housing extend a distance forward of said front row of flaps to catch and collect improperly putted golf balls.

5. A dual purpose golf putting practice device as recited in claim 3, wherein said front row of flaps includes a horizontal beam from which said front row of flaps are suspended, and a stud at the top of said beam, to which said first assemgly may be detachably connected.

6. A dual purpose golf putting practice device as recited in claim 5, includes additional hoizontal beams rearward of said first mentioned hoizontal beam, and from which additional hoizontal beams, additional rows of flaps are suspended to further control movement of a putted ball with said housing.

7. A dual purpose golf putting practice device as recited in claim 1, wherein the flaps are adapted to bend in the direction of a rolling golf ball when impacted thereby, with the bent portions of the flaps engaging the putted golf ball and creating sufficient resistance to the golf ball's continued movement to either stop the ball, or allow it to pass therethrough depending on the force of the putted ball.

8. A dual purpose golf putting practice device for use indoors or outdoors comprising a series of spaced apart, horizontal linear rows of individual flaps, suspended vertically to pivot from their upper edges, and having on top of a first entrance row of said linear rows of flaps, a target cage including cylindrically arranged flaps positioned such that opposite half portions of the cylindrically arranged flaps are respectively located in front of and rearward of said entrance row of linear flaps whereby the front half portion of said cylindrically arranged flaps serves as a target entrance gate to the putting practice device and a rolling golf ball may be caused to stop at any one of successive stages of passage, including the target entrance gate, the first entrance row, and the rear half portion of the cylindrical flaps, and a golfer may evaluate the required force required to putt from various distances and retain the rolling golf ball within the target cage.

9. A dual purpose golf putting practice device as recited cited in claims 1 and 8, including means for regulating the rigidity of the flaps, so that the amount of putting force required to move the putted golf ball past the flaps may be controlled.

10. A dual purpose golf putting practice device as recited in claim 9, wherein said regulating means is a horizontally arranged barrier bar, supported adjacent said flaps, and against which said flaps are pressured upon movement thereof by a putted golf ball.

* * * * *